US007757421B1

(12) United States Patent
Tompkins et al.

(10) Patent No.: US 7,757,421 B1
(45) Date of Patent: Jul. 20, 2010

(54) FIREARM ACCESSORIES

(75) Inventors: Taylor Tompkins, Flower Mound, TX (US); Todd Liddell, Roanoke, TX (US)

(73) Assignee: Mud Brothers Inc, Southlake, TX (US)

( * ) Notice: Subject to any disclaimer, the term of this patent is extended or adjusted under 35 U.S.C. 154(b) by 0 days.

(21) Appl. No.: 12/319,436

(22) Filed: Jan. 7, 2009

(51) Int. Cl.
*F41A 35/04* (2006.01)

(52) U.S. Cl. ..... 42/96; 206/317

(58) Field of Classification Search ..... 42/96; 206/317

See application file for complete search history.

(56) References Cited

U.S. PATENT DOCUMENTS 2,364,340 A * 12/1944 Bogg, Jr. ..... 42/106
2,826,523 A * 3/1958 Blaszkowski et al. ..... 428/12
2,932,334 A * 4/1960 Steen ..... 206/317
6,119,388 A * 9/2000 Jones et al. ..... 42/96
6,425,494 B1 * 7/2002 Woods, II ..... 220/739
6,829,863 B2 * 12/2004 Lovas ..... 52/211
7,347,019 B1 * 3/2008 Shaw ..... 40/607.01
7,559,168 B2 * 7/2009 Wisecup et al. ..... 42/96
2003/0234058 A1 * 12/2003 Tippins ..... 138/149

OTHER PUBLICATIONS

Scopecoat Barrel Boot; http://www.scopecoat.com/products/barrel_boot.html; Aug. 19, 2007; date verified using www.archive.org and viewable at http://web.archive.org/web/*/http://www.scopecoat.com/products/barrel_boot.html and http://web.archive.org/web/20070819154009/http://www.scopecoat.com/products/barrel_boot.html.*

* cited by examiner

*Primary Examiner*—Michael Carone
*Assistant Examiner*—Gabriel J Klein
(74) *Attorney, Agent, or Firm*—Gary C. Honeycutt

(57) ABSTRACT

A gun protection device comprising an elastic muzzle cover shaped to fit selectively over the muzzle and only a portion of the barrel; and a separate cover for the gun firing chamber, including means for shaping itself to provide a selective fit over the firing chamber.

3 Claims, 2 Drawing Sheets

FIREARM ACCESSORIES

FIELD OF THE INVENTION

This invention relates to accessories for a firearm; and more particularly to accessories for protecting a shotgun or rifle.

BACKGROUND

If you have ever owned a shotgun or rifle, you probably have sought to protect your gun from the weather, and from accidental damage. Gun covers and gun cases have been widely available for such purposes for hundreds of years. There are many different types of gun cases and covers, most of which are waterproof. They protect the entire gun, and they are generally very effective when used for gun storage.

However, during a hunting trip, an ordinary gun cover cannot be repeatedly removed and replaced with great convenience. And while the cover is off the gun, you cannot readily place it in your pocket. It can be a real nuisance to carry, when not in use. Also, if you were to fall or drop the gun while the cover is off, there is a good chance dirt, mud, snow or other debris may enter the muzzle or the chamber. Any obstruction in the barrel becomes an immediate danger to the user and all nearby hunters, since the gun may explode if fired.

SUMMARY OF THE INVENTION

The invention comprises an elastic cover for selectively protecting the muzzle of a gun; and a separate cover for selectively protecting the chamber. The muzzle cover has sufficient elasticity to fit snugly on small and large barrels. The chamber cover is structured to provide an adaptable shape and size in order to fit chambers having different shapes and sizes.

The adaptable dimensions are provided by embedding two or more parallel bands of curved metal within the chamber cover. When the cover is placed around the gun chamber, the metal bands act to fix the shape of the cover and to hold the cover in place.

This two-piece cover can readily be removed and replaced as often as needed. Also, the pieces fit it an average pocket with ease, so they do not become a separate burden. They are much more convenient than a full cover, while providing totally adequate protection.

DETAILED DESCRIPTION OF THE PREFERRED EMBODIMENTS

Figure 1:
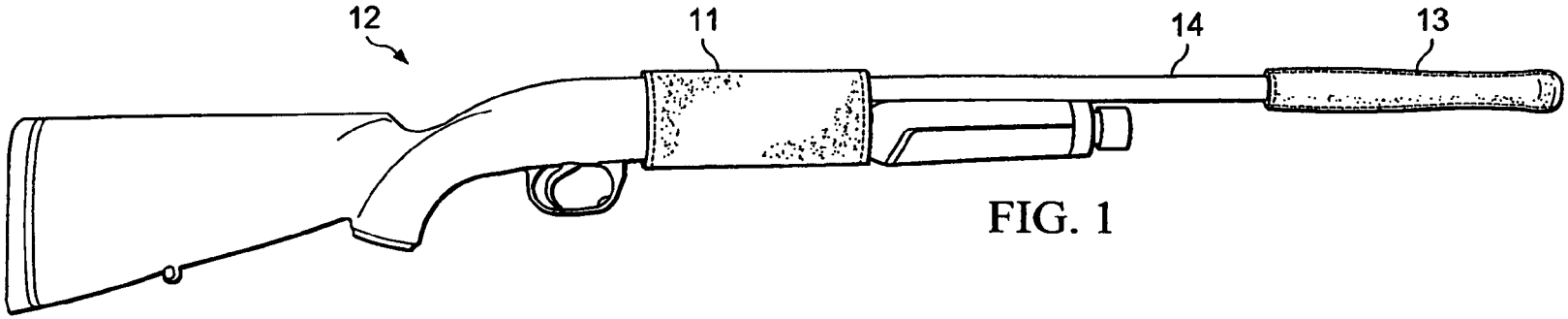
FIG. 1 is a side view of a firearm having the muzzle cover and chamber cover in place.

As shown in FIG. 1, chamber cover 11 is fixed in place on the firing chamber of shotgun 12. The internal construction of cover 11 enables it to assume the shape of the gun, and thereby remain snugly in place, to prevent mud, rain, snow, ice and/or other debris from entering the chamber. Muzzle cover 13 is fixed in place over the muzzle and only a portion of barrel 14, to prevent the entry of mud, rain, snow, ice and/or other debris. It remains in place because of its elastic grip on a portion of barrel 14. The preferred construction materials for both covers are selected to be waterproof, flexible, rugged and durable. The muzzle cover is also heat-resistant, within the range of barrel temperatures caused by frequent firing of the gun.

Figure 2:
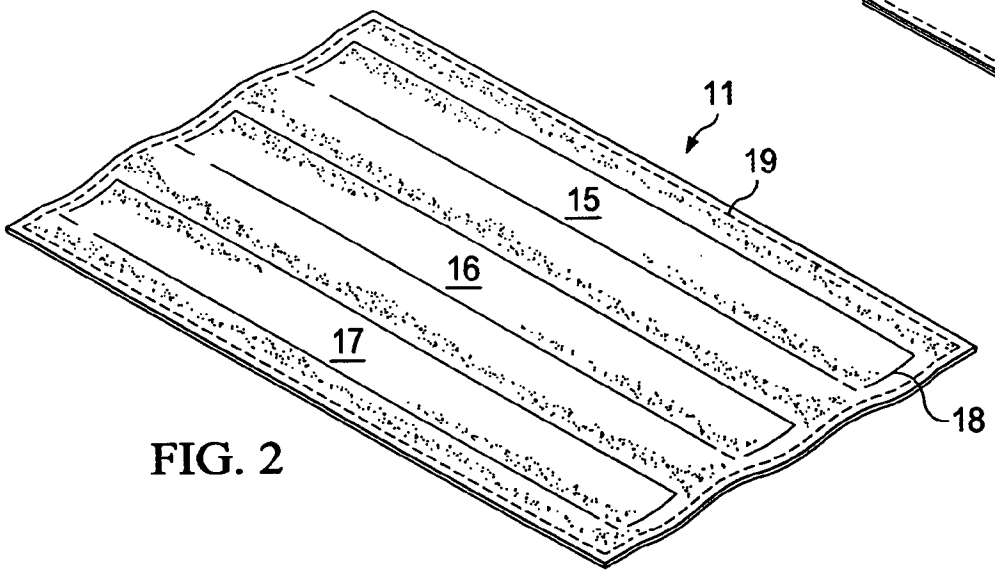
FIG. 2 is a perspective view of the chamber cover when flat.

As shown in FIG. 2, chamber cover 11 includes parallel metal bands 15, 16 and 17 spaced apart within the cover. The bands have a spring-like function, allowing the user to wrap the cover over the top and sides of a rifle or shotgun. Once the cover is in place, the metal bands cause the cover to retain its new shape, determined by the shape of the gun. The cover can be repeatedly removed and re-used by simply forcing the metal bands to re-shape the cover.

Each of the bands has a slight transverse curvature 18 along its entire length when the cover is flat. Bending the cover causes each band to lose its transverse curvature at one or more locations, and to become longitudinally curved at such locations, which acts to fix the new shape of the cover. When not in use, the cover can easily be forced to bend along its entire length, which forms a tubular roll that fits readily in an ordinary pocket. Stitches 19 hold the layers together.

The illustrated chamber cover is about 9 inches long and about 6 inches wide. This size was selected for convenience, while other dimensions are also useful. The preferred metal bands are made of steel having a thickness of about 0.16 mm, a width of about 25 mm and about a 1.5 inch radius of curvature. Other materials and dimensions are also useful. For example, a thickness of 0.10 to 0.20 mm and a width of 15 to 35 mm may be used. The radius of curvature may be selected within the range of 1 to 3 inches.

Figure 3:
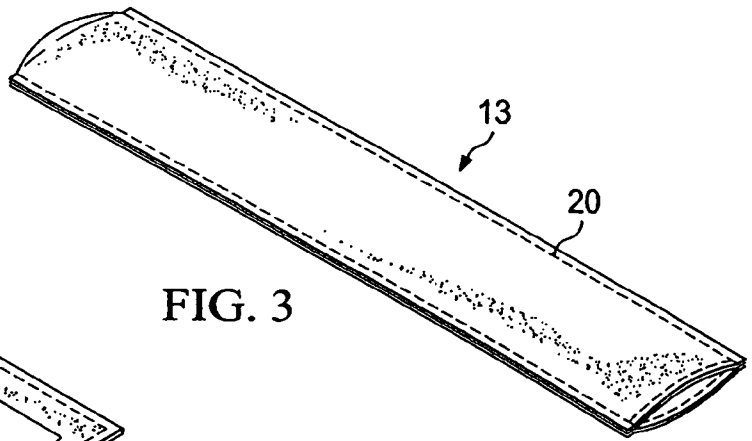
FIG. 3 is a perspective view of the muzzle cover.

As shown in FIG. 3, muzzle cover 13 is a neoprene sleeve having one open end and one closed end. Stitches 20 join the two neoprene layers at the edges. This construction allows the sleeve to be stored flat.

Figure 4:
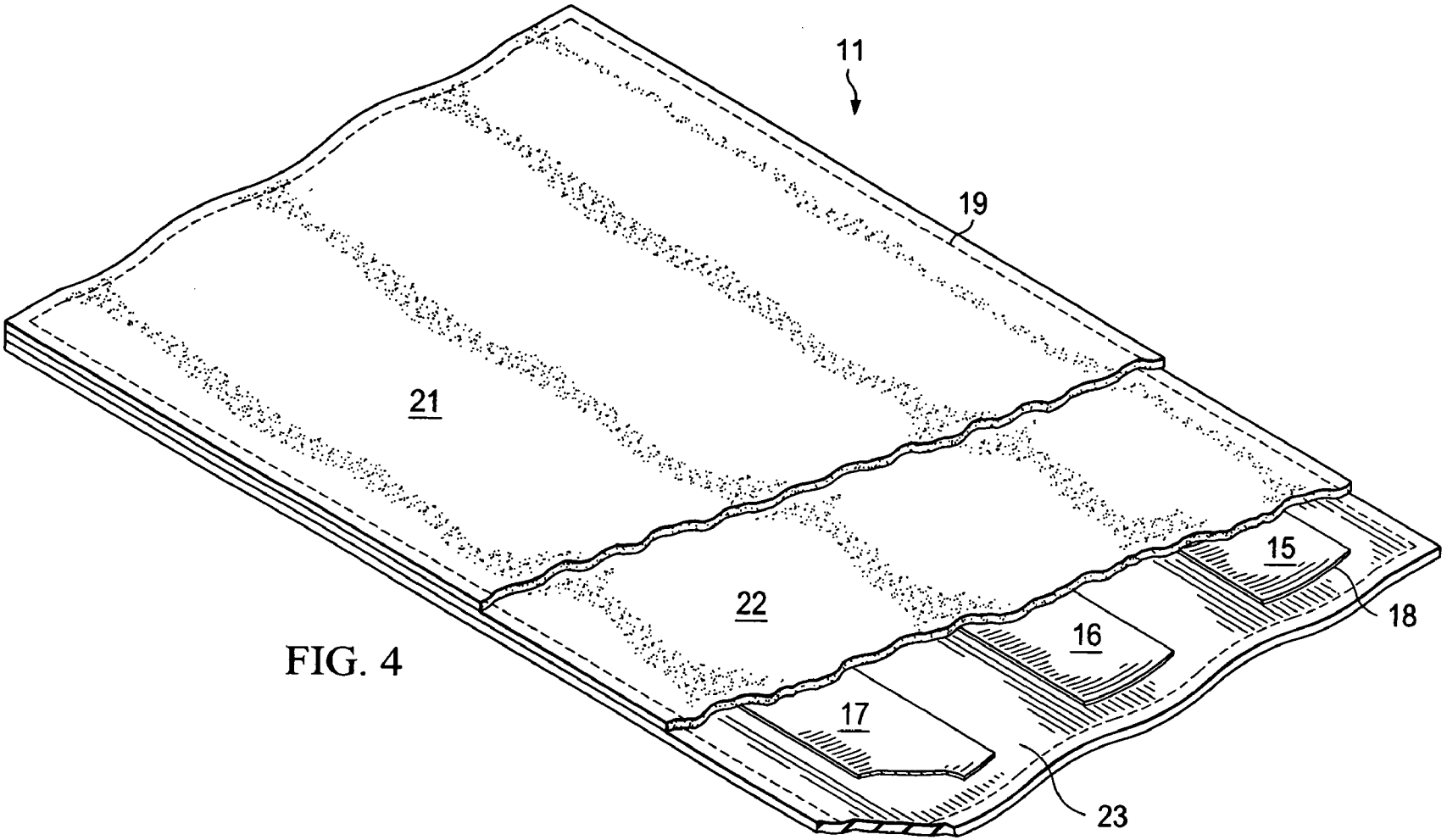
FIG. 4 is a partial cutaway view of the chamber cover in perspective, to reveal its layered construction.

As shown in FIG. 4, chamber cover 11 has a layered construction comprising a rugged fabric layer 21 and two neoprene layers 22 and 23 joined by stitches 19. Metal bands 15, 16 and 17 are located between the two neoprene layers. Nothing extra is required to hold the bands in place because the softness of neoprene surfaces inherently prevents the bands from moving about. Preferably, a soft rubber or similar coating is added to the ends of each metal band, to prevent the edges from gradually wearing through the neoprene.

The spring action of the metal bands works in one direction only. Thus in the example of FIG. 4, neoprene layer 23 is folded around the gun chamber, leaving fabric layer 21 exposed to the elements.

Although the edges of each layer are exposed in the drawing, it is preferred to stitch a piping strip over the edges, which improves the quality and durability of the cover. Similarly, piping is preferred on the edges of the muzzle cover.

Many variations are included within the scope of the invention. For example, nylon, canvas, rubber, Gore-Tex, cotton, tin-cloth, polyester, or wax impregnated cloth can be substituted for neoprene, but the quality and durability of the substitutes are not equivalent to neoprene. Similarly, these same choices may be used for layer 21, and for the piping strip, but they are not equivalents. The metal bands may be made of aluminum or other metals, and may even be made of composites or plastic, but the quality and durability are not usually as good.

Although the preferred chamber cover includes three layers as illustrated, a two-layer chamber cover is a possible variation. For example, fabric layer 21 can be omitted, but such a variation is much less durable, and lacks the quality provided by a proper selection of fabric for layer 21.

The invention claimed is:

1. A firearm having a firing chamber, a barrel, and a muzzle; said firearm having in combination therewith:

a) an elastic waterproof sleeve selectively covering said muzzle and only a portion of said barrel; and b) a flexible waterproof cover selectively fitted over the top and both sides of said firing chamber, said cover including a plurality of parallel metal bands shaped to provide said cover with multiple configurations, such that it will adapt itself to cover firing chambers having different shapes, and will also readily retain a flat configuration for convenient temporary storage while not in use; wherein each of said metal bands has a thickness of about 0.16 millimeter, a width of about 25 millimeters, and a transverse curvature radius of about 1.5 inches.

2. A kit comprising an elastic waterproof sleeve for selectively protecting the muzzle of a firearm, and a flexible waterproof cover for selectively protecting the firing chamber of a firearm; wherein said cover includes a plurality of parallel metal bands shaped to provide said cover with multiple configurations, such that it will adapt itself to cover firing chambers having different shapes, and will also readily retain a flat configuration for convenient temporary storage while not in use; wherein each of said metal bands has a thickness of about 0.16 millimeter, a width of about 25 millimeters, and a transverse curvature radius of about 1.5 inches.

3. A method for temporary protection of a firearm having a muzzle and a firing chamber, comprising the steps of placing an elastic waterproof sleeve over the muzzle; and placing a separate, flexible waterproof cover over the firing chamber, said cover including a plurality of parallel metal bands shaped to provide multiple cover configurations, such that it adapts itself to fit the shape of the firing chamber and will also readily retain a flat configuration, said metal bands having a transverse curvature.

* * * * *